US009833090B2

(12) United States Patent
Ross et al.

(10) Patent No.: US 9,833,090 B2
(45) Date of Patent: Dec. 5, 2017

(54) COFFEE CUP LID

(71) Applicant: Highwave, Oxnard, CA (US)

(72) Inventors: Gary Ross, Oxnard, CA (US); Griffin Ross, Oxnard, CA (US)

(73) Assignee: HIGHWAVE, Oxnard, CA (US)

( * ) Notice: Subject to any disclaimer, the term of this patent is extended or adjusted under 35 U.S.C. 154(b) by 0 days.

(21) Appl. No.: 15/530,361

(22) Filed: Jan. 3, 2017

(65) Prior Publication Data

US 2017/0208975 A1 Jul. 27, 2017

Related U.S. Application Data

(60) Provisional application No. 62/286,419, filed on Jan. 24, 2016.

(51) Int. Cl.

| | |
|---|---|
| ***A47G 19/22*** | (2006.01) |
| ***B65D 43/02*** | (2006.01) |
| ***B65D 47/32*** | (2006.01) |
| ***B65D 51/18*** | (2006.01) |
| ***B65D 43/14*** | (2006.01) |

(52) U.S. Cl.

CPC ..... *A47G 19/2272* (2013.01); *B65D 43/0204* (2013.01); *B65D 43/14* (2013.01); *B65D 47/32* (2013.01); *B65D 51/18* (2013.01); *B65D 2251/009* (2013.01); *B65D 2251/0015* (2013.01); *B65D 2251/0081* (2013.01); *B65D 2543/00046* (2013.01)

(58) Field of Classification Search

CPC ..... A47G 19/2272; B65D 43/0204; B65D 47/32; B65D 51/18; B65D 43/14; B65D 2251/009; B65D 2543/00046; B65D 2251/0015; B65D 2251/0081

USPC ..... 220/254.4, 719, 821

See application file for complete search history.

(56) References Cited

U.S. PATENT DOCUMENTS

| | | | | | |
|---|---|---|---|---|---|
| 2,033,042 | A * | 3/1936 | Mazzella | B65D 47/265 | 220/821 |
| 4,077,538 | A * | 3/1978 | Waterbury | B65D 17/506 | 220/268 |
| 4,106,665 | A * | 8/1978 | Cannon | B65D 47/265 | 220/254.4 |
| 4,712,704 | A * | 12/1987 | Ramsey | A47G 19/2272 | 220/254.4 |
| 4,779,766 | A * | 10/1988 | Kinsley | B65D 47/0876 | 220/254.3 |
| 5,148,936 | A * | 9/1992 | DeGrow | B65D 47/0876 | 220/254.3 |
| 6,003,711 | A * | 12/1999 | Bilewitz | B65D 43/0218 | 220/253 |

(Continued)

*Primary Examiner* — James N Smalley

(74) *Attorney, Agent, or Firm* — Jonathan E. Grant; Grant Patent Services

(57) ABSTRACT

A flexible coffee lid having memory having memory is disclosed. The d coffee lid comprises a circumferential cap structure, which in turn comprises aid circumferential cap structure comprises a a vent hole positioned on a platform for supporting the vent hole, a b) a drink hole, the drink hole positioned 180 degrees from the vent hole, the drink hole positioned on a platform for supporting the drink hole; c) a diaphragm centrally located on the upper platform; and a rotatable flexible sealing closure element that has the ability to seal both the vent hole and the drink hole, said rotatable flexible. The lid also has a diaphragm.

9 Claims, 12 Drawing Sheets

(56) References Cited

U.S. PATENT DOCUMENTS

2007/0039960 A1* 2/2007 Pawlik ..... B65D 51/18
220/254.7

* cited by examiner

COFFEE CUP LID

This application claims priority under 35 USC 120 to provisional application 6262/286,419 filed Jan. 24, 2016, and is incorporated in its entirety herein.

A flexible universal spill resistant coffee lid is disclosed which can fit securely on almost any standard disposable cup and which keep the liquid contents hot for a longer period of time.

The figures depict various embodiments of the described methods and system and are for purposes of illustration only. One skilled in the art will readily recognize from the following discussion that alternative embodiments of the methods and systems illustrated herein may be employed without departing from the principles of the methods and systems described herein.

DETAILED DESCRIPTION OF THE DISCLOSURE

The present disclosure is for a container cover or lid which accommodates a snap fit retention onto a conventional circumferential rim of any standard coffee beverage cup. As with typical disposable lids this lid also acts to be retained as a cover or lid in a very secure manner. The lid has a drink hole and a vent hole.

More specifically, the proposed coffee lid limits or prevents spillage. The lid is made of a flexible, non-toxic material. In one embodiment, the lid is made from silicon, rubber, an elastomeric plastic, or any elastic plant material. In one embodiment, the material used is silicon.

The silicon construction allows this to easily adjust to the slightly different cup brands that typically have a specific lids or family of lids that fit best on any paper coffee cup brand.

The silicon construction allows this to easily adjust to the slightly different cup brands that typically have a specific lids or family of lids that fit best on any paper coffee cup brand. For Example, some cups have a slightly fatter lip and the double wall cup design makes it a bit more unique. Another popular cup has a thinner lip and slightly greater OD. The present lid fits either design, and in fact, the silicone design fits any brand cup with a combination of the inside design of the lid and its shore hardness to allow enough stretch to be secure on any cup brand. The Shore hardness of the silicon or material used allows enough stretch to be secure on any cup brand The Snap fit retention coffee lid fits on any standard coffee beverage container. In one embodiment, the lid is reusable, such as when the lid uses a material such as silicon, or a flexible, elastic plastic. Other versions of the disclosure may use materials that are disposable.

Figure 1:
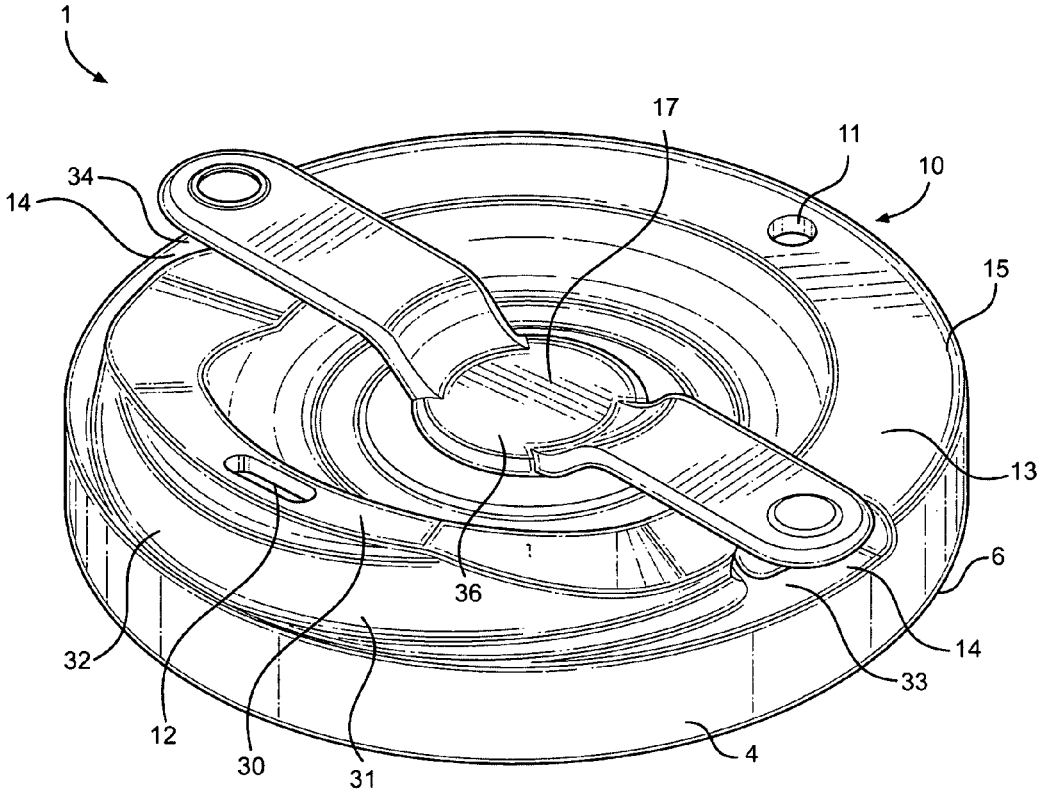
FIG. 1 is a front perspective view of the coffee lid with the flexible sealing member rotated.
Figure 2:
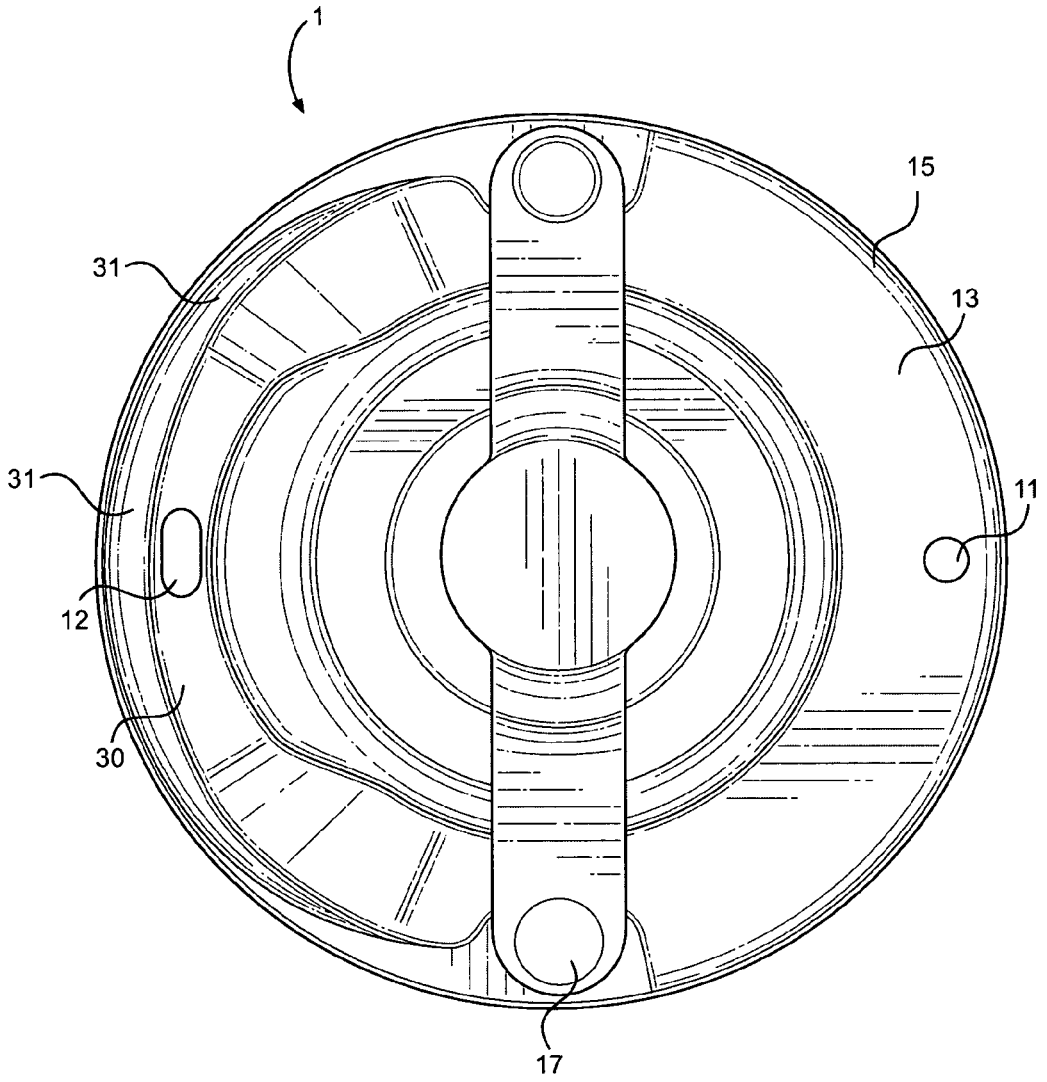
FIG. 2 is an overhead view of the coffee lid with the lid cover rotated.
Figure 3:
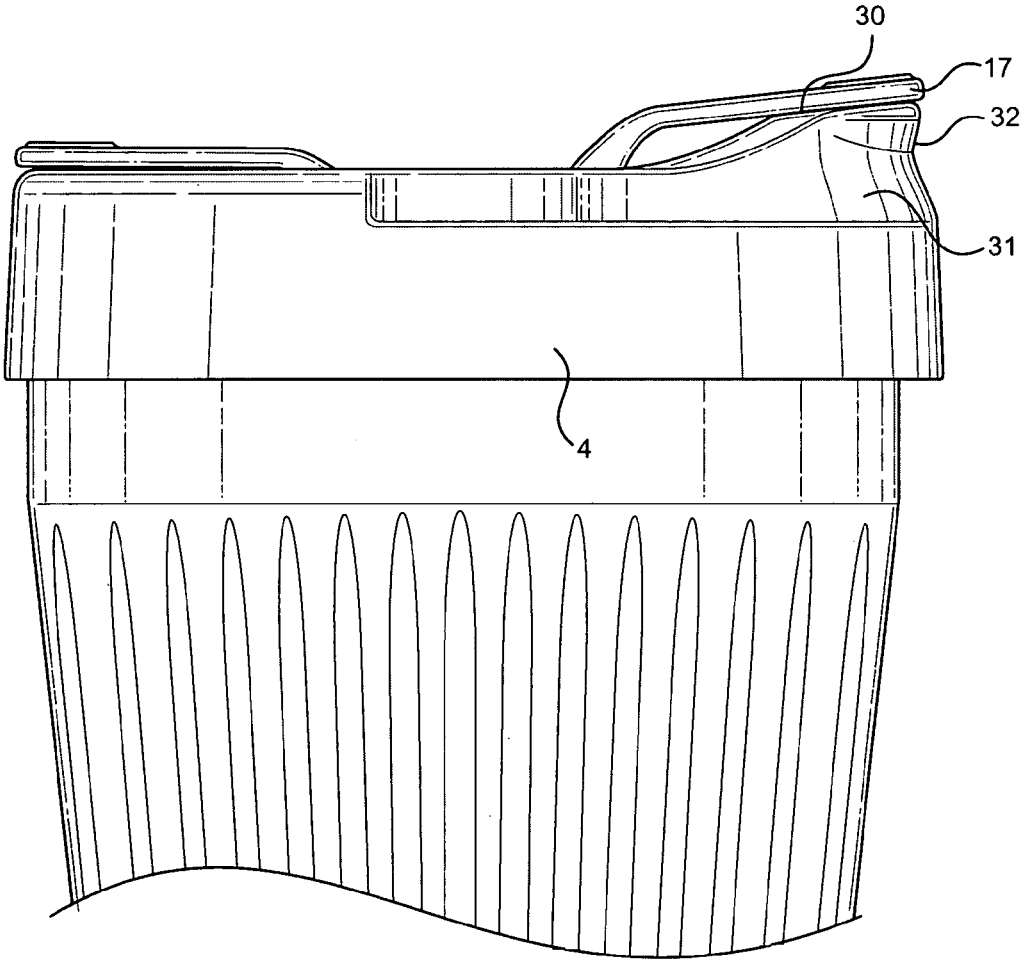
FIG. 3 is a first side view of the coffee lid, with the flexible sealing member covering the sip hole and the vent holes wherein the diaphragm is expanded.
Figure 4:
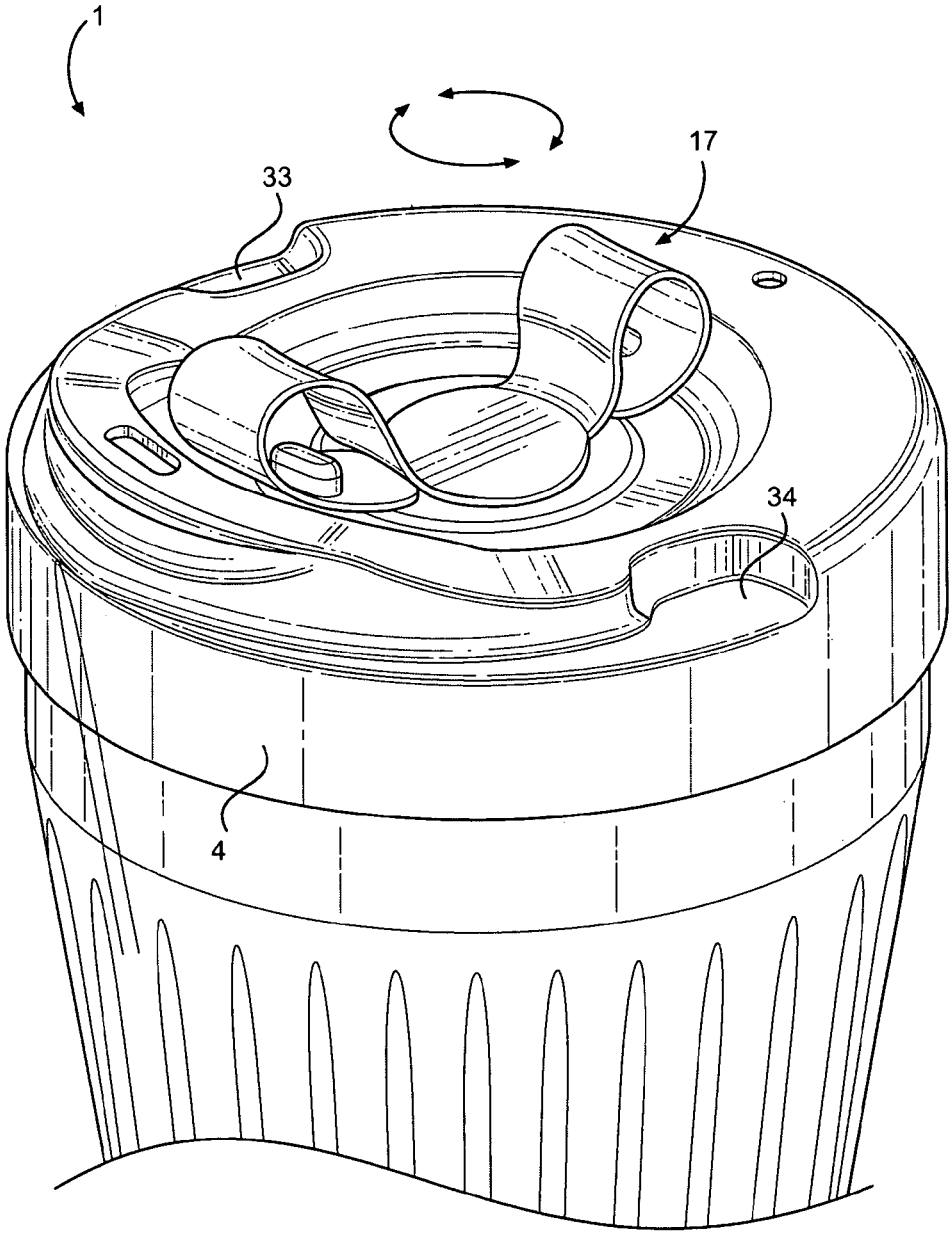
FIG. 4 is a perspective view of the coffee lid showing the first wing member of the flexible sealing member tucked under itself and thedia second wing member of the flexible sealing member tucked under itself.
Figure 5:
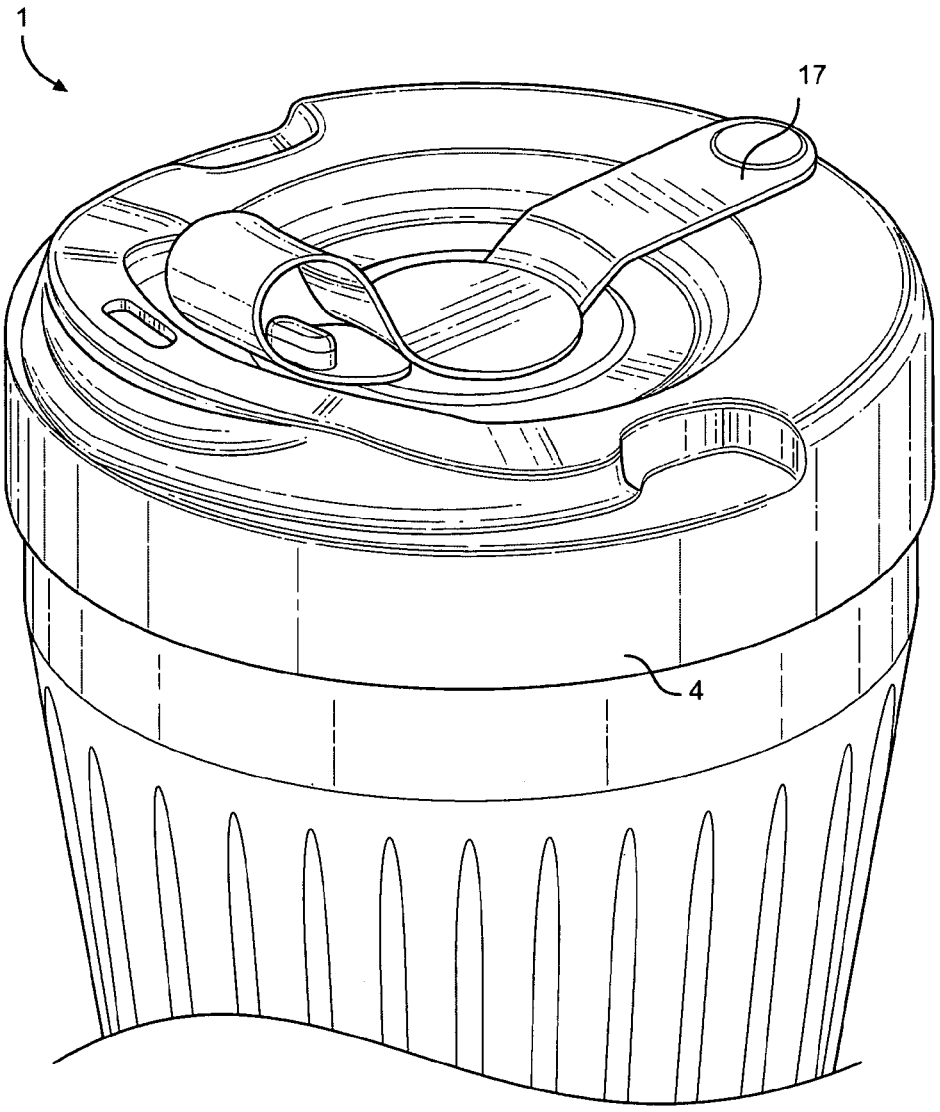
FIG. 5 is a perspective view of the coffee lid showing the front section of the coffee lid with the first wing of the flexible sealing member tucked under itself.
Figure 6:
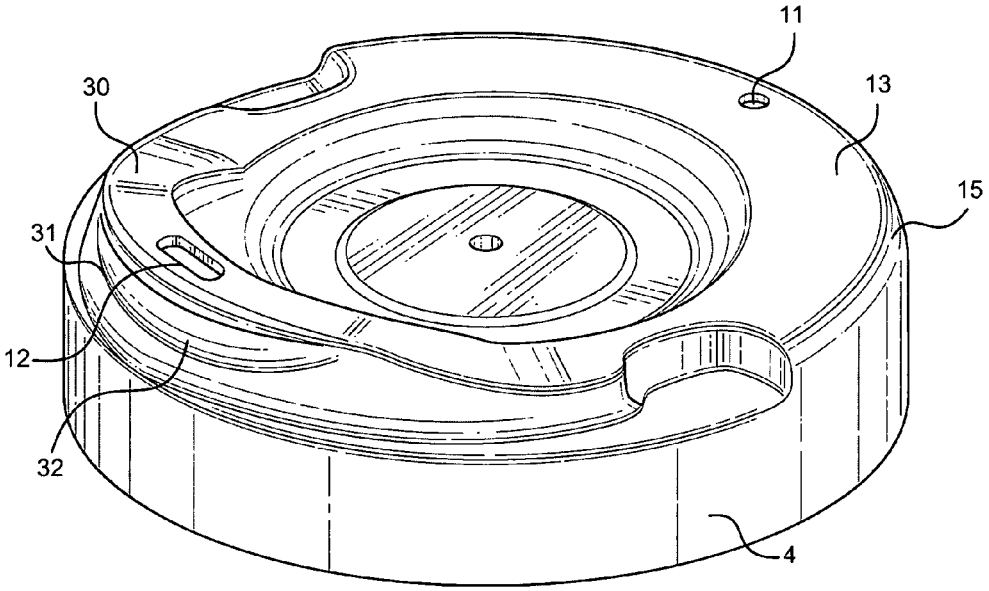
FIG. 6 is a perspective view of the coffee lid without the flexible sealing member.
Figure 7:
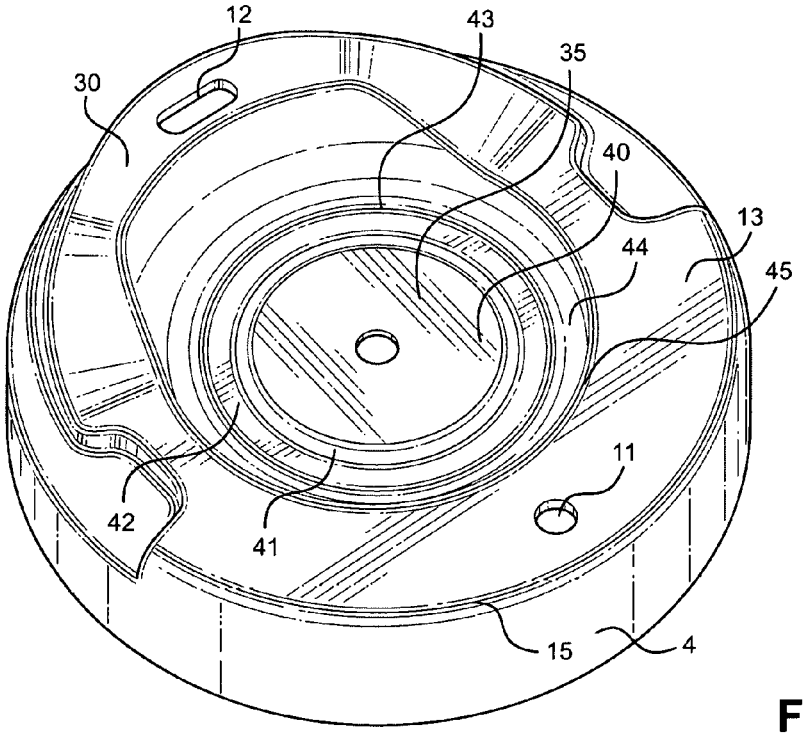
FIG. 7 is an overhead perspective view of the top of the coffee lid without the flexible sealing member.
Figure 8:
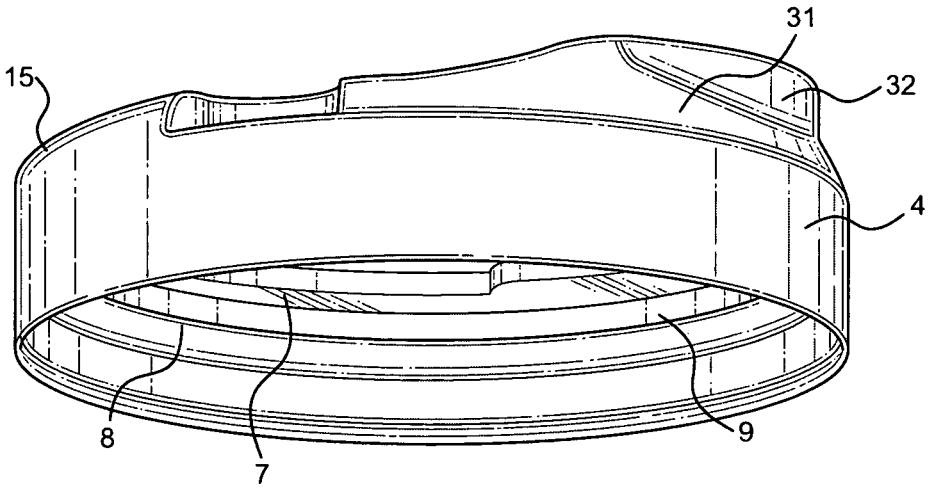
FIG. 8 is a perspective view of the coffee lid showing the inside edge of the coffee lid.
Figure 9:
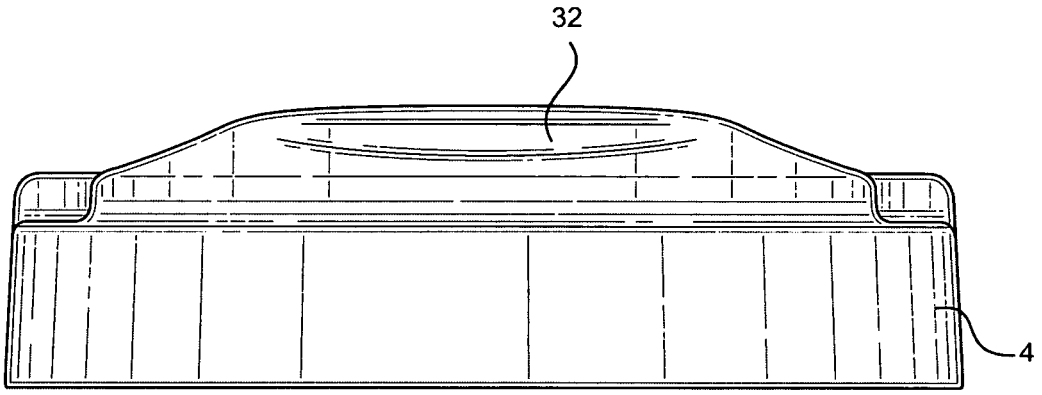
FIG. 9 is front view of the coffee lid.
Figure 10:
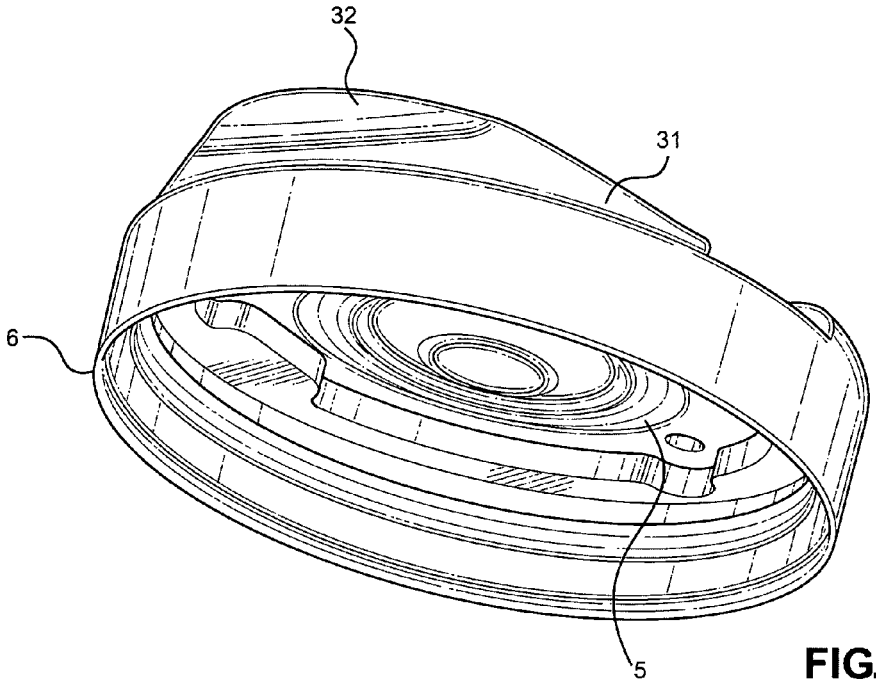
FIG. 10 is another perspective view of the inside of the coffee lid showing the inside edge and the underside of the lid.
Figure 11:
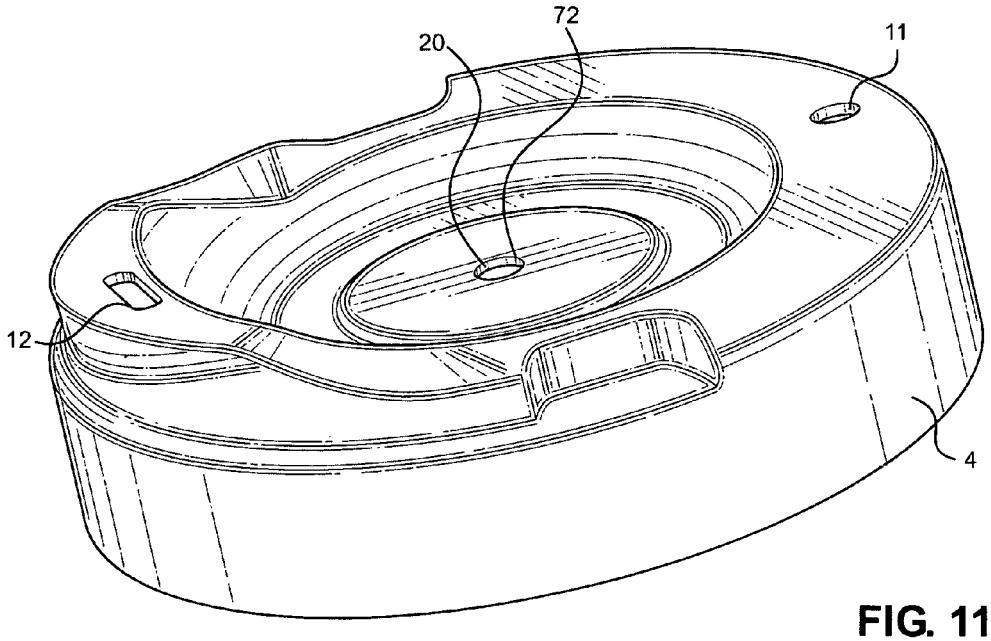
FIG. 11 is another perspective view of the coffee lid.
Figure 12:
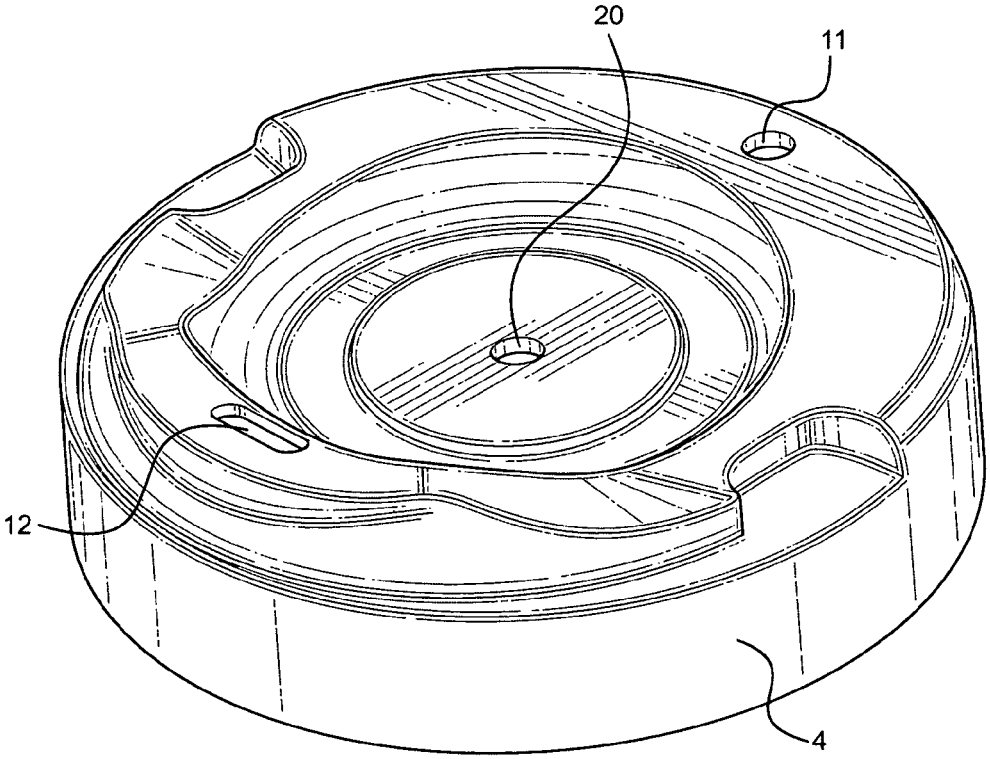
FIG. 12 is a perspective view of the inner rim of the outside of the coffee lid.
Figure 13:
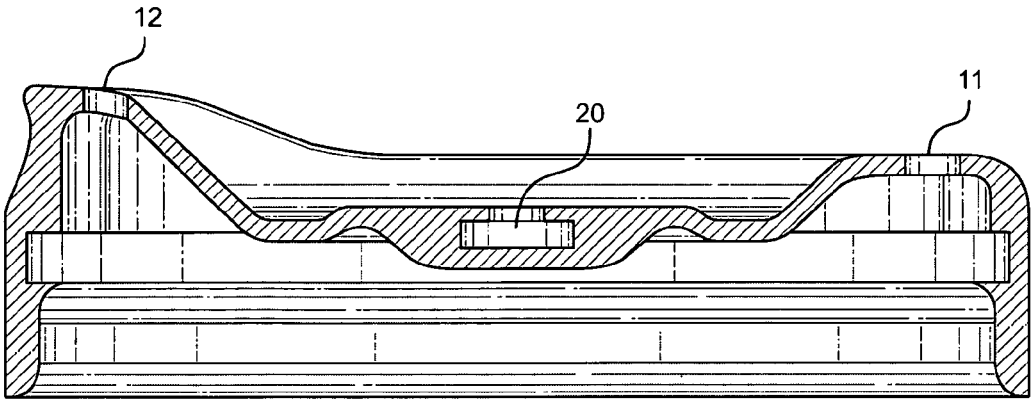
FIG. 13 is a cross section of the coffee lid.
Figure 14:
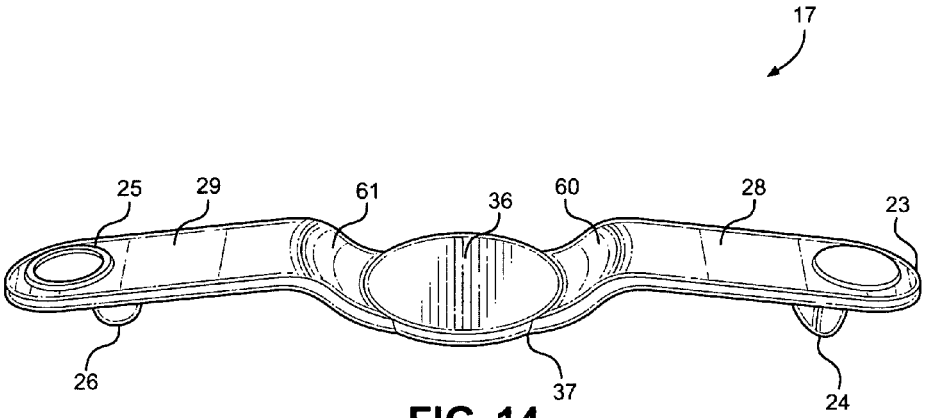
FIG. 14 is a perspective view of the flexible sealing member.
Figure 15:
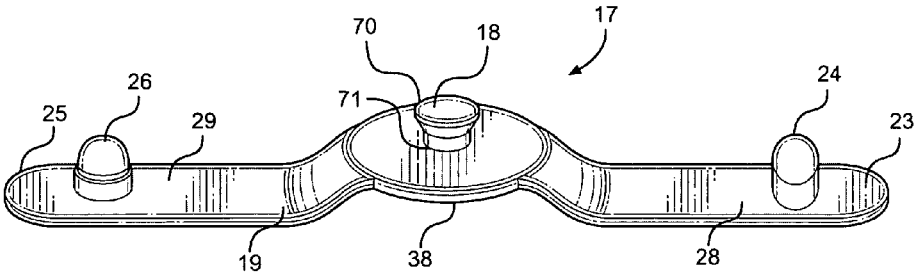
FIG. 15 is a perspective view of the underside of the flexible sealing member.
Figure 16:
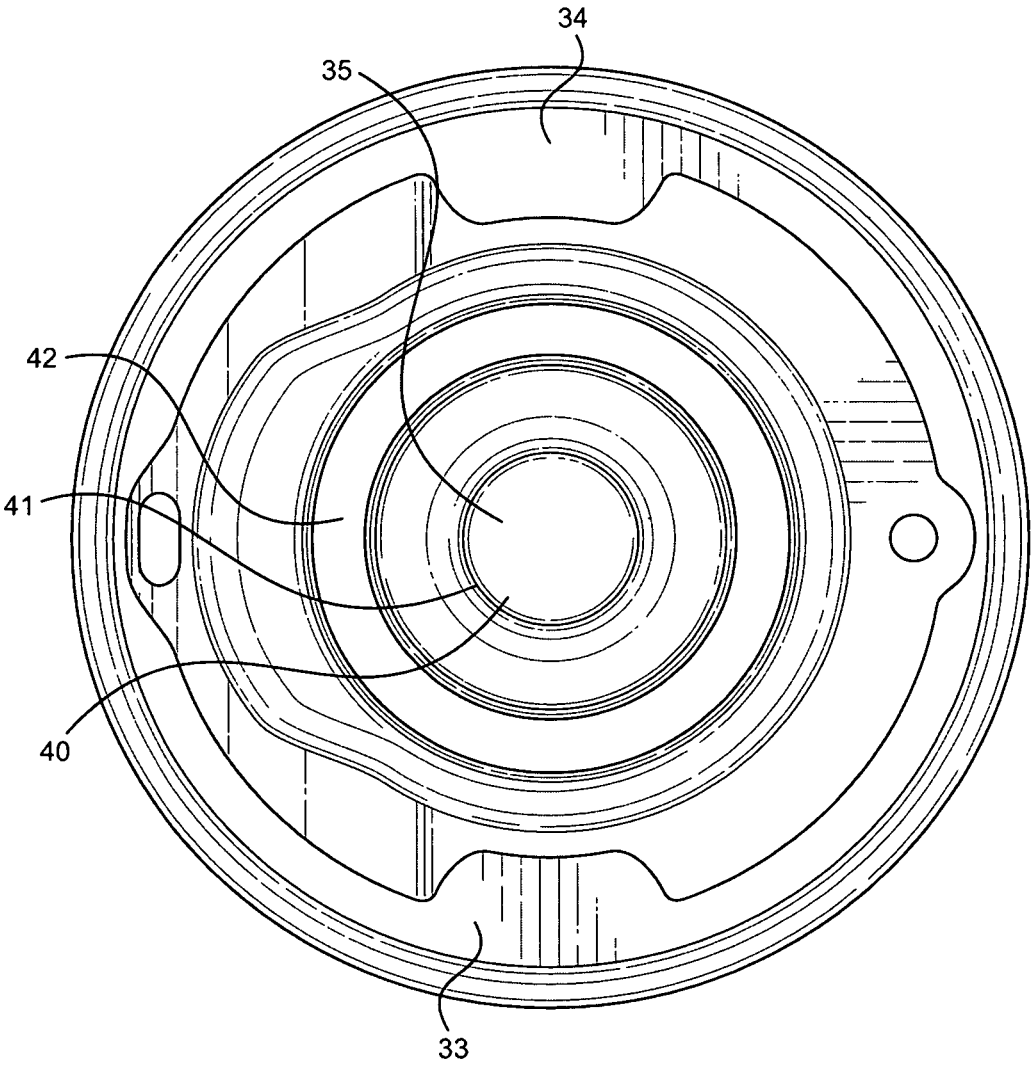
FIG. 16 is an overhead view of the underside of the coffee lid.
Figure 17:
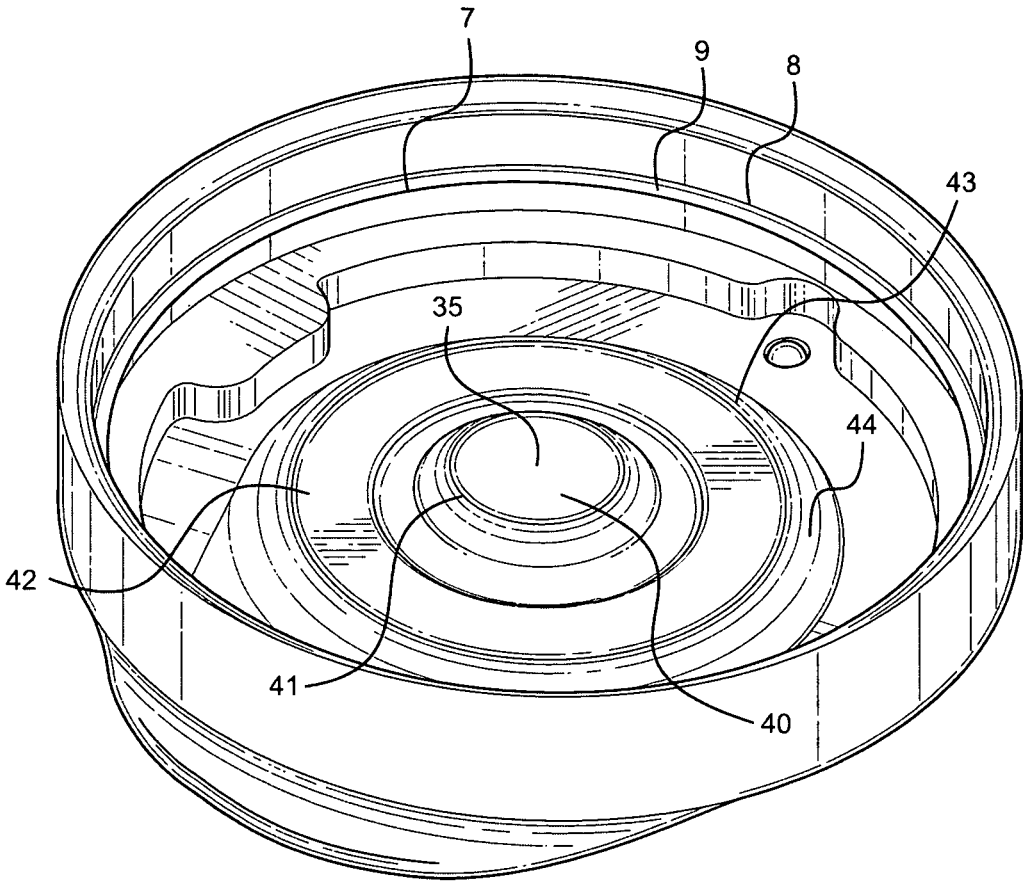
FIG. 17 is a perspective view of the underside of the coffee lid.

Referring to FIGS. 1-17, the coffee lid 1 comprises a circumferential cap structure 2 and a rotatable closure element 17. The circumferential cap structure 2, and for that matter, the entire coffee lid, 1 as mentioned supra, is made of a flexible non-toxic material. In one embodiment, it is made of silicon. The Shore hardness allows enough stretch to be secure the circumferential on any cup brand. The cap structure 2 has positioned at its bottom, a circumferential rim 3 positioned at the bottom of a circumferential curtain 4 that fits over a cup. As the cap structure fits over the cup, the rim of the cup fits within the cap structure 3. Because of the Shore hardness and stretchability of the silicon material, the circumferential curtain 4 and its length thereof make it easier to position the put the coffee lid over any "standard" coffee cup. More specifically, in one embodiment, and measuring downward, the circumferential curtain 4 has a width of 0.5" to 1.5". In another embodiment, the circumferential curtain has a width of 0.5" to 1" and in another embodiment, the circumferential curtain has a width of 0.75" to about 1". This width allows for an easy fitting of the coffee lid 1 over the cup. One can fold back part of the circumferential curtain 4 when inserting the cap structure on top of the coffee cup, and then letting the circumferential curtain 4 fit around the cup. In one embodiment an outward bevel 5 around the bottom edge 6 of the circumferential curtain 4 makes it easier to slip the lid over the cup.

Near the top around the inside of the circumferential curtain 4 is a first bottom interior circumferential lip 7. A second top interior circumferential lip 8 extends beyond the length of the first bottom interior circumferential lip 7. Between lips 7 and 8 is a cup rim groove 9, which, as the name infers, is the groove 9 into which the lip of the paper coffee cup fits, thereby securing the lid to the coffee cup. In one embodiment, the cup rim groove 9 is either rectangular or square. The quadrangle group stretched over a round top rim gives up to three sealing opportunities. A distinct arc of silicone contact is at the top middle and bottom of square groove. The groove is 4 mm wide, with the top of the groove 11 mm to the bottom. Lip 8 has an outward flair of 1.5 mm that locks or supports the lip of the paper cup. Lip 7 is about 16 mm to the bottom of the circumferential curtain. It should be noted that the positioning of the groove and the lips may be varied, as may be the width of the curtain 4. The shape and length of the groove 9 help secure the lid 1 to the coffee cup, and makes it easier to place the flexible rim over the top. In another embodiment, the groove 9 exists without lip 8 and/or lip 7

Consequently, if the (coffee) cup is knocked over, the point of impact hits the circumferential curtain 4. As the cup lip is fully surrounded with silicone and because the silicone extends downward below the groove 9, the coffee lid 1 does not slip or come off from the coffee cup. More specifically, if the coffee cup is knocked over while the coffee lid 1 is in place, the force will be distributed against the silicone, and the silicone will push against the rim of the cup, absorbing some of the shock, not forcing off the cup as is typical of polystyrene tops.

Furthermore, because of the elasticity of the silicon or other materials used, and because the width of the groove 9 has the average width of any cup at 4 mm and with the coffee cup lid fitting any paper/styrofoam/plastic having an outside diameter of 88-91 mm. The coffee lid 1 is actually firmly grabbing the cup, thereby limiting the chance of leakage. It should be noted that the coffee cup lid 1 can be made to come in different sizes, depending on the need, and the size of the coffee cup used. A larger cup with a larger diameter will have a larger coffee cup lid 1.

Sitting above the circumferential curtain 4 is the service or upper platform 10 of the lid. The upper platform 10 has a vent hole 11 and a drink hole 12. The vent hole resides on an elevated top semi-circumferential vent platform 13 that resides on a semi-circular rim 15, while the drink hole 12 is positioned on a drink hole rim 30 of a dual tapered elevated top semi-circumferential lip support 31. The top circumferential vent platform 13 and drink hole rim 30 may be either flat, tilted inward, or tiled outward. In one embodiment, the vent hole 11 is smaller than the drink hole 12, although both holes are larger than the average vent holes and drink holes found in lids. The vent hole 11 is positioned 180 degrees opposite of the drink hole 12.

The oversized vent hole 12 has a unique function, that allows the user to very quickly cool down the coffee in only 10 seconds by blowing into the elevated drink hole. The air is forced over the surface of the very hot coffee and pulls heat off the coffee to cool it to a drinkable range and the very hot air will exit the larger vent hole. If the customer does not want to vent while drinking to keep the coffee hot longer the closure element system is rotated to plug the vent hole as in FIG. 5.

The top semi-circumferential lip support 31 has a rounded indentation 32 positioned below drink hole rim 30. This indentation 32 conforms to the average person's lip, and is ergonomically designed to maximize comfort. The area of the indentation is thick enough to provide enough insulation that that there is no discomfort to the drinker's lip if the drink is too hot.

The flexible sealing closure element 17 seals both the vent hole 11 and the drink hole 12. Specifically, the flexible sealing closure element 11 has a centralized plug 18 on its underside 19 of its central section 36. This plug fits snugly into a well hole 20 positioned in an centralized platform 21 on top of and in the center of the lid 1. The well hole 20 is closed on its bottom section 22 so as not to add another potential place for any leakage. Note that the centralized plug 18 has a wider base 70 and a narrower neck 71. The perimeter 72 of the well hole 20 is slightly narrower than the well hole 20 itself, such that when the centralized plug 18 is pushed into the well hole 20, the perimeter 72 parts enough to allow the wider base 70 to fit through, while at the same time the perimeter 72 fits close to the neck 71 and prevents the flexible sealing closure element 17 from falling out without the force of a person's fingers removing it.

The flexible sealing closure element 17 also has on its underside 19 at a distal end 23 of a first arm extension 28 a drink hole plug 24 specifically for shaped for said drink hole 12. To clarify, the first arm extension 28 is connected to a first arm 60 which is connected to the central section 36 at the first end 37 of the first arm 60. At the distal end 25 of the second arm extension 29 on the underside 19 is a vent hole plug 26, again specifically shaped to fit the vent hole 11. The second arm extension 29 is connected to the second arm 61. The two plugs are positioned 180 degrees from each other. Both plugs 24, 26 are sized so as to fit securely into the appropriate holes, with little or no likelihood of accidentally falling or popping out of the vent hole plug 26 or the drink hole plug 24 accidentally, even if dropped. The vent hole 11 and drink hole 12 are large enough to easily locate and plug, and provide both greater longevity, and a more secure seal. It is also easier to cool the liquid inside the cup if the vent is larger.

Because there are two arms 60, 61 with arm extensions 28, 29 of the flexible sealing closure element 17, they can work independently or together. For example, if one just wants to uncover the vent hole 11, the vent hole plug 26 is pulled from the vent hole 11, and the arm extension 29 having the vent hole plug 26 is tucked under itself and the tip or end 25 of the arm extension 29 is placed or wedged under and against the central section 36 or under the arm 61. Similarly, if one just wants to uncover the drink hole 12, or wants to uncover the drink hole 12 in addition to uncovering the vent hole 11, the drink hole plug 24 is pulled from the drink hole 12, and the first arm extension 28 having the drink hole plug 24 is tucked under first arm 60 and/or end 23 of the arm extension 28 is placed or wedged under and against the central section 36.

It should be noted that in one embodiment of the disclosure, the arms 60, 61 are articulated. In another embodiment, the arms 60, 61 are outwardly angular whereupon the extensions are integrally attached. This is because the centralized platform 21 is below the surface of drink hole 12 and vent hole 11 and the angularly positioned articulated arms prevent strain that could otherwise lead to the vent hole plug 26 and the drink plug 24 popping out of their respective holes In another embodiment, the lid 1 is designed so the two arm 60, 61 and arm extensions 28, 29 of the flexible sealing closure element 17 easily rotate in either direction. To unseal the coffee cup—to go from sealed to unseal, the ends 23, 25 of the arm extensions 28, 29 pulled upwards such that the drink hole plug 24 and the vent hole plug 26 are freed. The flexible sealing closure element 17 is then rotated 90 degrees, wherein the drink hole plug 24 and the vent hole plug 26 nest in two depressions 33, 34 on the side and the rib located on the neck of each plug to hold these in a "carport" like area.

These depressions 33, 34 are snuggly bounded by the semi-circumferential lip support 31 and the semi-circular platform 13, and rest on top of a the support platform 14. lowers the possibility that the plug will be in contact with a user's hand or other possibility for contact with germs.

Because of the tight fit of the drink hole plug 24 and the vent hole plug 26 into the drink hole 12 and the vent hole 11, the lid is virtually leak proof. If the cup filled with a hot liquid inside is jostled or shaken even more pressure builds up. Any leak tight system has to consider the temperature and with high temperature comes pressure. If a closed vessel is agitated it can increases the pressure of very hot liquid in the in the vessel. If the vessel is knocked over it may add increased pressure in the vessel and the force of the liquid can put more pressure on a specific part of the lid like the vent hole stopper or the drink hole stopper. Turning a coffee upside down puts even more pressure on the seals combined with the pressure and added pressure if the vessel has some movement that increases the pressure.

Consequently, to mitigate the extra pressure, the cup lid has the diaphragm 35 built into the central part of the lid to mitigate the extra pressure. Typically, if there is very hot coffee in the cup, the entire center of the proposed lid will rise upward with the increased pressure of the hot coffee. This acts to take pressure off the plug seals of the top. If by chance the coffee falls, there is less likelihood of leakage if the added pressure is allowed to expand the diaphragm 35 without pushing the lid 1 off of the cup. The articulated bent arms 60, 61 of the closure element 17 easily ride upward with the increase pressure in a cup of hot coffee, and. The articulated bent arms 60, 61 tend to relax and fall when the cup is in the "drink" position with one or both plugs 24, 26 un-plugged. The arms extend and contract without any pressure on the seals. The articulated closure elements extend outward to accommodate with no pulling pressure on the seals to guarantee a leak tight seal on oversized rims. The articulated bent arms 28, 29 extend and contract with out any pressure on the seals.

The diaphragm 35 is positioned in the center of the top of the lid 1. In one embodiment, the diaphragm 35 can comprise one central section (not shown). In another embodiment, the diaphragm comprises a central section 40 surrounded by and integrally connected to an outer flange 41 that works in cooperation with the central section 40. The outer rim 42 of the outer flange 41 integrally connects to the first rim 42 of collar 43 which integrally circumscribes the diaphragm 35. The second rim 44 of collar 43 circumscribe the continuous inside rim 45 formed by bounded by the semi-circumferential lip support 31 and the top semi-circumferential vent rim 13.

The coffee lid 1 can be used for more than just the standard paper, ceramic or styrofoam coffee cups. By having different sizes of the coffee lid 1, the lid can be used on travel mugs, or even water bottles or water thermoses.

If using on a surface without a lip, such as on a travel mug (also known as a travel tumbler), which do not have the rims found on coffee cups, there is no need to include in the lid a groove for the lip.

This lid also has other applications. A larger version can be used for paint cans and other such materials.

While various embodiments of the present disclosure have been described above, it should be understood that they have been presented by way of example only, and not limitation. It will be apparent to persons skilled in the relevant art that various changes in form and detail can be made therein without departing from the spirit and scope of the disclosure. Thus, the breadth and scope of the present disclosure should not be limited by any of the above-described exemplary embodiments, but should be defined only in accordance with the following claims and their equivalents.

What we claim is:

1. A flexible coffee lid comprised of a material having memory, said coffee lid comprising:

a) a circumferential cap structure, said circumferential cap structure comprising:

I) a circumferential curtain, said circumferential curtain comprising:

i) an exterior extended circumferential wide rim that has the ability to be stretched over and cover a top section of a coffee cup; and ii) a circumferential bottom edge which is fittable over said coffee cup, said circumferential bottom edge positioned at a bottom of the exterior extended circumferential wide rim;

b) an upper platform, said upper platform comprising:

i) a semi-circumferential vent platform positioned on a semi-circular rim;

ii) a vent hole positioned on said semi-circumferential vent platform;

iii) a drink hole, said drink hole positioned 180 degrees from said vent hole, said drink hole positioned on said upper platform for supporting said drink hole;

iv) a diaphragm centrally located on said upper platform; and v) a rotatable flexible sealing closure element that has the ability to seal both the vent hole and the drink hole, said rotatable flexible, comprised of:

vi) a centralized plug on an underside of the rotatable flexible sealing closure element which fits into a well positioned in a top of said diaphragm;

vii) a flexible first arm, said flexible first area comprising:

A) a first end; and

B) a second end, said second end having a drink hole plug on said underside;

viii) a flexible second arm said flexible second arm comprising:

A) a first end; and

B) a second end said second end having a vent hole plug on said underside.

2. The flexible coffee lid of claim 1, further comprising a universal inner groove within which a rim of a coffee cup is fitted, near the top of the inside of said circumferential wide rim.

3. The flexible coffee lid of claim 2, further comprising a) a first interior circumferential lip within said circumferential curtain, said first interior circumferential lip positioned above said universal inner groove; and b) a second interior circumferential lip within said circumferential curtain, said second interior circumferential lip positioned below said universal inner groove.

4. The flexible coffee lid of claim 2, wherein a cross section of said universal inner groove is rectangular.

5. The flexible coffee lid of claim 4, wherein cross section of said universal inner groove is square.

6. The flexible coffee lid of claim 1, wherein said platform for supporting said drink hole comprises:

a) a rim;

b) a semi-circumferential lip support, upon which said rim resides.

7. The flexible coffee lid of claim 6, wherein said semi-circumferential lip support further comprises a rounded indentation positioned below said drink hole, said rounded indentation conforming to a lip of an average person.

8. The flexible coffee lid of claim 1, wherein said coffee lid is made out of silicone.

9. The flexible coffee lid of claim 1, further comprising:

a) a first depression for storing the drink hole plug, said first depression positioned 90 degrees from said drink hole; and b) a second depression for storing the vent hole plug, said second depression positioned 90 degrees from said vent hole plug.

* * * * *